US006651830B2

(12) United States Patent
Pan

(10) Patent No.: US 6,651,830 B2
(45) Date of Patent: Nov. 25, 2003

(54) TOWEL RACK

(75) Inventor: Chin-Chi Pan, Chang Hua (TW)

(73) Assignee: Sheng Tai Brassware Co., Ltd. (TW)

( * ) Notice: Subject to any disclaimer, the term of this patent is extended or adjusted under 35 U.S.C. 154(b) by 0 days.

(21) Appl. No.: 10/006,391

(22) Filed: Dec. 10, 2001

(65) Prior Publication Data

US 2002/0088764 A1 Jul. 11, 2002

(30) Foreign Application Priority Data

Jan. 11, 2001 (CN) ..... 01200194 U

(51) Int. Cl.[7] ..... A47H 1/02

(52) U.S. Cl. ..... 211/105.1; 211/123; 248/222.14; 248/251

(58) Field of Search ..... 211/105.1, 113, 211/123; 248/251, 201, 309, 222.14, 213.4; D6/524

(56) References Cited

U.S. PATENT DOCUMENTS 1,276,463 A * 8/1918 Wells ..... 211/123
1,799,558 A * 4/1931 Howard ..... 211/105.2
1,893,729 A * 1/1933 Call ..... 248/222.14
1,934,911 A * 11/1933 Campbell ..... 248/222.14
1,997,686 A * 4/1935 Hoegger ..... 248/222.14
4,060,332 A * 11/1977 Jacobsen ..... 248/251
4,102,529 A * 7/1978 Neblung et al. ..... 248/251
4,662,593 A * 5/1987 Shames et al. ..... 248/201
5,186,427 A * 2/1993 Semchuck ..... 248/224.7
5,217,123 A * 6/1993 Riley et al. ..... 211/105.1
5,402,977 A * 4/1995 Korfgen et al. ..... 211/89.01
5,931,427 A * 8/1999 Pan ..... 211/16
6,019,233 A * 2/2000 Yu ..... 211/87.01

* cited by examiner

*Primary Examiner*—Alvin Chin-Shue
*Assistant Examiner*—Khoa Tran
(74) *Attorney, Agent, or Firm*—Bacon & Thomas, PLLC

(57) ABSTRACT

A towel rack. The rack includes two fastening bases, two retaining heads, and a towel rod. The fastening bases are fastened onto a wall surface such that the two fastening bases are separated from each other by a predetermined distance. The retaining heads are joined with the fastening bases for retaining two longitudinal ends of the towel rod.

2 Claims, 5 Drawing Sheets

PRIOR ART

Fig • 2

TOWEL RACK

FIELD OF THE INVENTION

The present invention relates generally to a rack, and more particularly to a towel rack.

BACKGROUND OF THE INVENTION

As shown in FIGS. 1 and 2, a towel rack of the prior art comprises two fastening bases 10, two retaining heads 13, and a towel rod 16 held between the two retaining heads 13. The fastening bases 10 are provided with a connection pillar 11 which is provided with a tapered slot 12. The retaining heads 13 is fitted with the connection pillar 11 in conjunction with a screw 14. The retaining head 13 is fastening securely with the fastening base 10. The base 10 is fastened onto the wall by a plurality of fastening bolts 15. The base 10 and the retaining head 13 are relatively large in size, thereby resulting in high cost of production material. In view of the fact that the base 10 is made by compression casting or punching, the tapered slot 12 must be further processed by lathe at additional production cost. The retaining heads 13 are provided with a receiving slot 17 for receiving one end of the towel rod 16. The receiving slot 17 is devoid of any means to locate the towel rod 16, which can be easily turned. In addition, the towel rod 16 is monotonous in design.

SUMMARY OF THE INVENTION

The primary objective of the present invention is to provide a towel a rack which is free of the drawbacks of the prior art towel rack described above.

The features and the advantages of the present invention will be readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
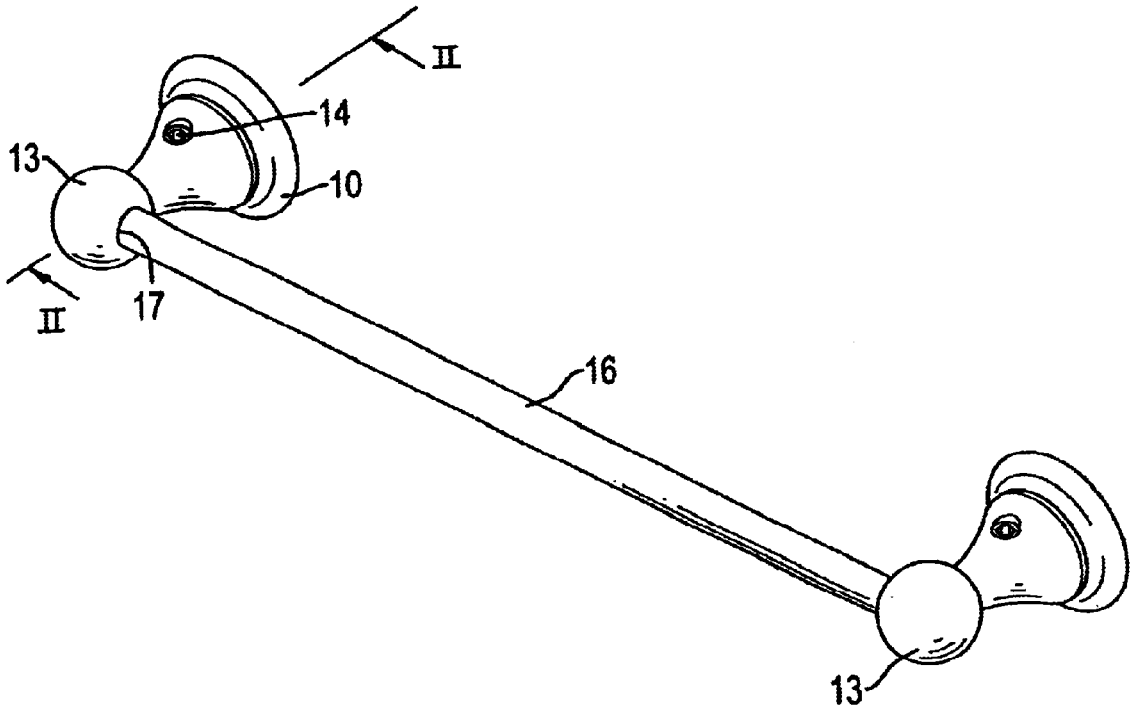
PRIOR ART Fig · 1
FIG. 1 shows a perspective view of a towel rack of the prior art.
Figure 2:
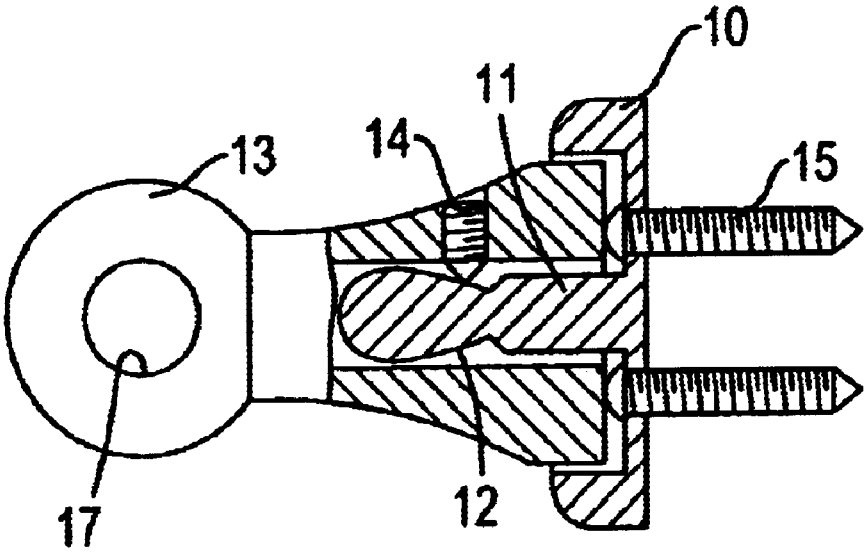
FIG. 2 shows a sectional view taken along the direction indicated by a line II—II as shown in FIG. 1.
Figure 3:
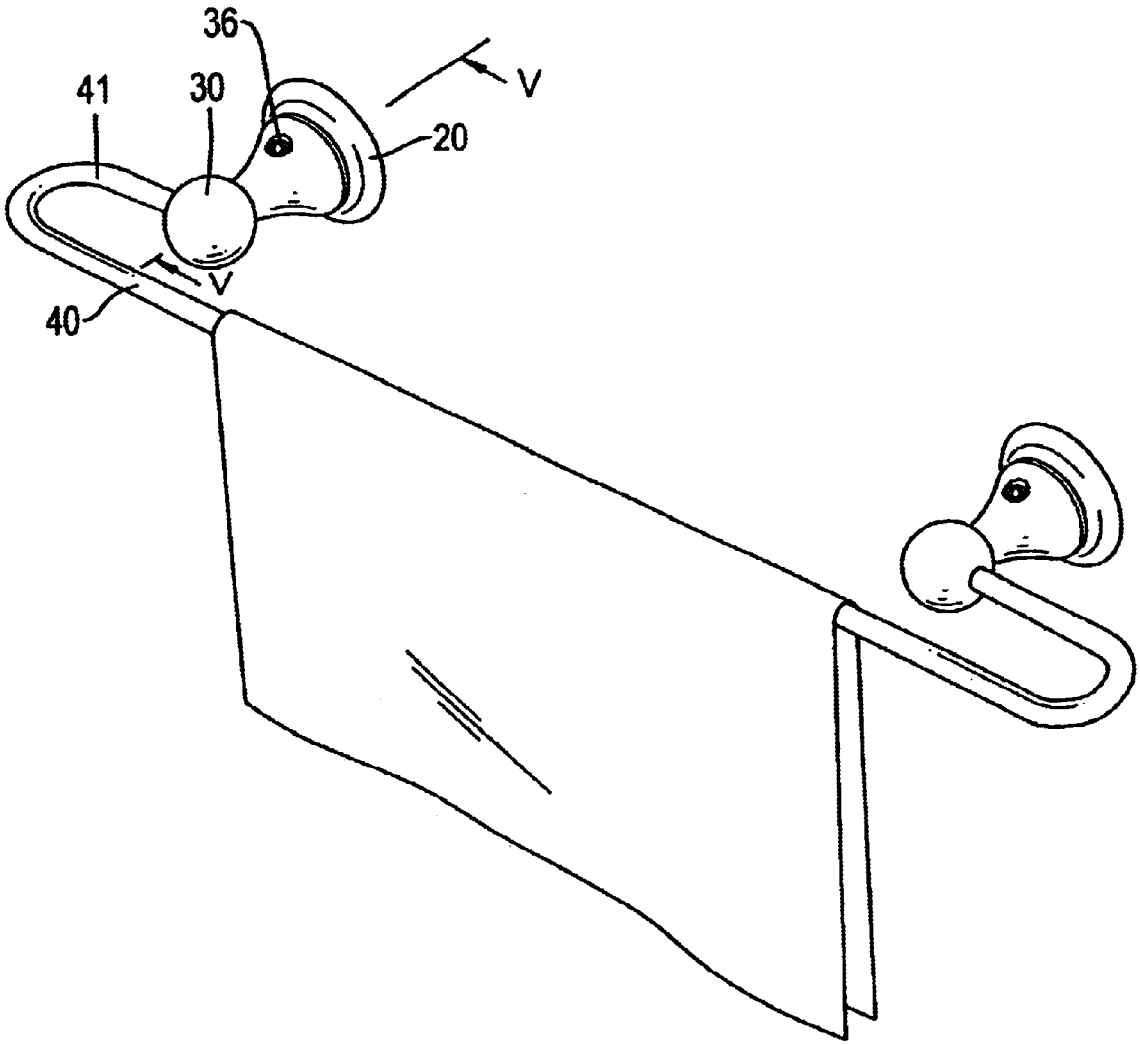
FIG. 3 shows a perspective view of the preferred embodiment of the present invention.
Figure 4:
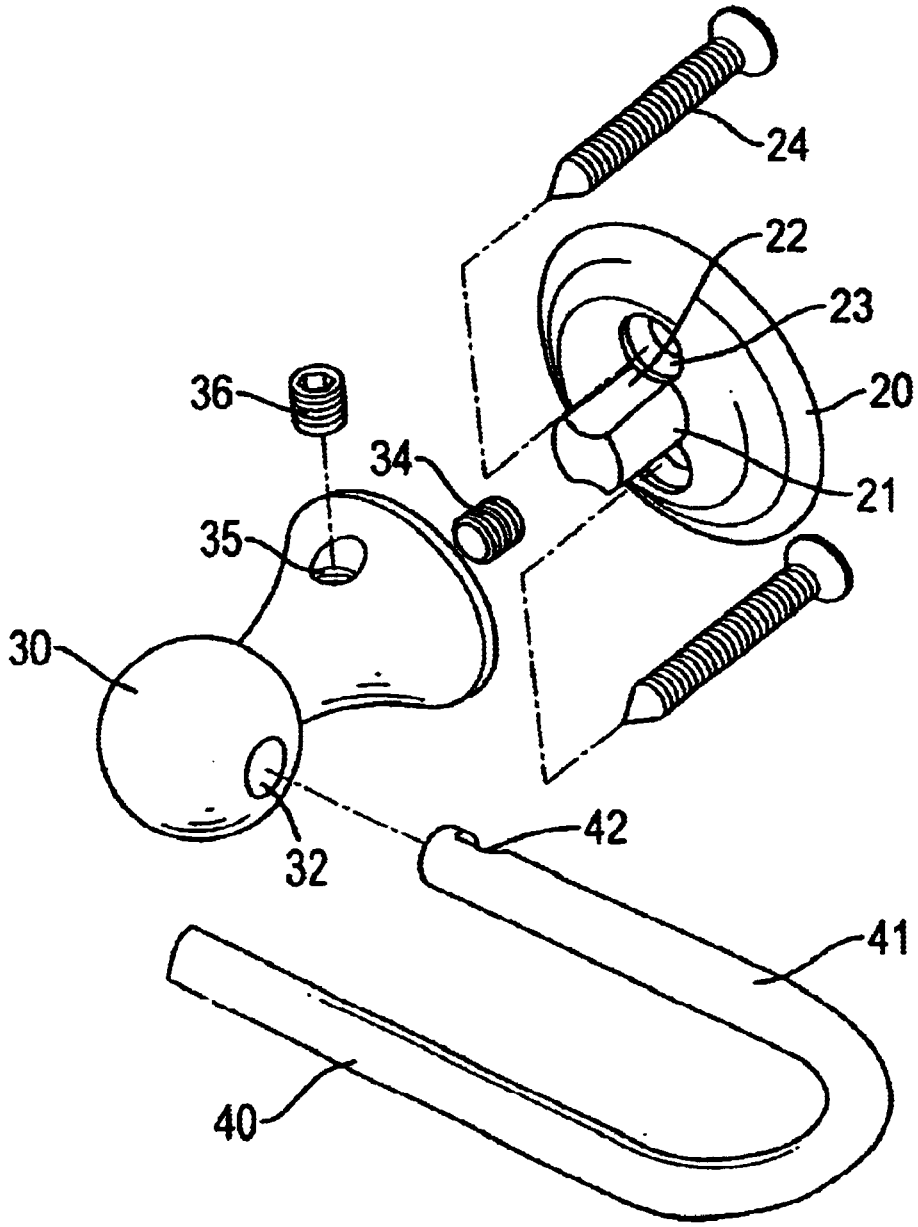
FIG. 4 shows an exploded view of the preferred embodiment of the present invention.
Figure 5:
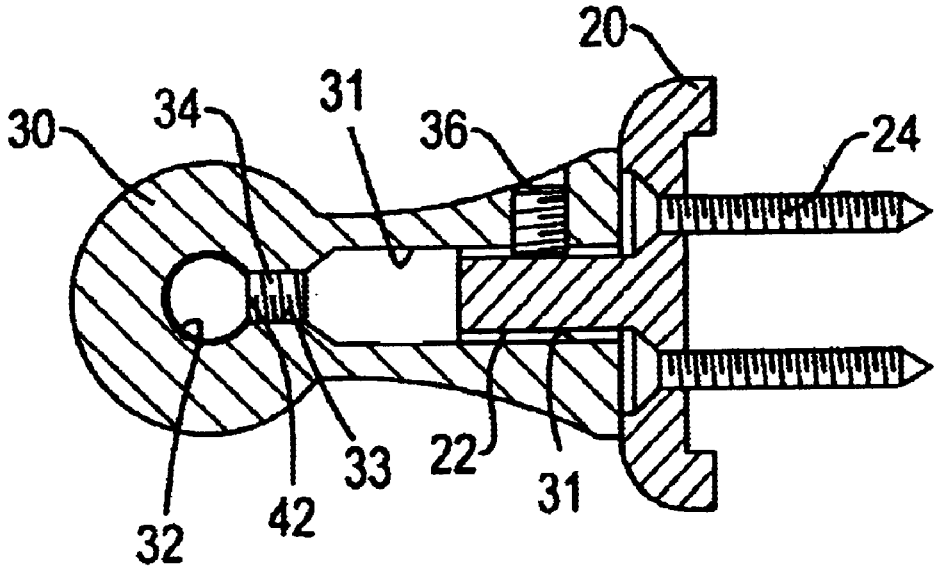
FIG. 5 shows a sectional view taken along the direction indicated by a line V—V as shown in FIG. 3.

As shown in FIGS. 3–5, a towel rack embodied the present invention comprises two fastening bases 20, two retaining heads 30, and a towel rod 40.

The fastening bases 20 are provided with a connection bar 21 extending from one side thereof and having two recesses 22 opposite to each other. The two recesses 22 are provided at the base end thereof with a locating hole 23. The fastening bases 20 are fastened to a wall surface by two fastening bolts 24 which are fastened onto the wall surface via the locating holes 23.

The retaining heads 30 are provided in the interior with a connection hole 31, a circular slot 32, and an inner threaded hole 33 located between the connection hole 31 and the circular slot 32 and provided therein with a headless screw 34. The retaining heads 30 are further provided with a threaded hole 35 corresponding in location to the recess 22 of the connection bar 21 of the fastening base 20. The retaining head 30 is joined with the fastening base 20 such that the connection bar 21 of the fastening base 20 is fitted into the connection hole 31 of the retaining head 30, and that a fastening bolt 36 presses against the connection bar 21 of the fastening base 20 via the threaded hole 33 of the retaining head 30.

The towel rod 40 has two U-shaped ends, each having a retaining arm 41 which is provided at the free end with a retaining slot 42. The towel rod 40 is retained between the two retaining heads 30 such that the retaining arm 41 is received in the circular slot 32 of the retaining head 30, and that the headless screw 34 of the retaining head 30 is retained in the retaining slot 42 of the retaining arm 41 of the towel rod 40.

The towel rack of the present invention is relatively cost-effective and free of the deficiencies of the prior art towel rack.

The embodiment of the present invention described above is to be regarded in all respects as being merely illustrative and nonrestrictive. Accordingly, the present invention may be embodied in other specific forms. For example, the towel rod 40 of the present invention may be of any configuration. The present invention is therefore to be limited only by the scopes of the following claims.

What is claimed is:

1. A towel rack comprising:

two fastening bases, each being provided with a connection bar extending from one side thereof and having two recesses opposite to each other, said two recesses provided at a base end thereof with a locating hole, said fastening bases being fastenable to a wall surface by fastening bolts which are fastenable onto a wall surface through said locating holes;

two retaining heads, each being provided in an interior thereof with a connection hole, a circular slot, and an inner threaded hole located between said connection hole and said circular slot and provided therein with a headless screw, each of said retaining heads being further provided with a threaded hole corresponding in location to a respective one of said recesses of said connection bars of said fastening bases, each of said retaining heads being joined with a respective one of said fastening bases such that said connection bars of said fastening bases are fitted into respective ones of said connection holes of said retaining heads, and that a pair of fastening bolts each presses against respective ones of said connection bars of said fastening bases via said threaded holes of said retaining heads; and a towel rod provided at two longitudinal ends thereof with a retaining slot, the towel rod retained between said two retaining heads such that each of the two longitudinal ends of said towel rod is received in a respective one of said circular slots of said two retaining heads, and said headless screw of each of said retaining heads is retained in respective ones of said retaining slots of said towel rod.

2. The towel rack as defined in claim 1, wherein said towel rod has two longitudinal ends of a U-shaped configuration.

* * * * *